US010815984B2

(12) United States Patent
Valentine

(10) Patent No.: US 10,815,984 B2
(45) Date of Patent: Oct. 27, 2020

(54) BEAM PUMPING UNIT WITH GEOMETRY OPTIMIZED FOR BEARING STRESS REDUCTION

(71) Applicant: Lufkin Industries, LLC, Lufkin, TX (US)

(72) Inventor: Garnett W. Valentine, Lufkin, TX (US)

(73) Assignee: Ravdos Holdings Inc., New York, NY (US)

( * ) Notice: Subject to any disclaimer, the term of this patent is extended or adjusted under 35 U.S.C. 154(b) by 228 days.

(21) Appl. No.: 15/666,526

(22) Filed: Aug. 1, 2017

(65) Prior Publication Data

US 2019/0040857 A1 Feb. 7, 2019

(51) Int. Cl.
*F04B 47/02* (2006.01)
*E21B 43/12* (2006.01)

(52) U.S. Cl.
CPC ..... *F04B 47/022* (2013.01); *E21B 43/127* (2013.01); *F04B 47/028* (2013.01)

(58) Field of Classification Search
CPC ..... F04B 47/028; F04B 47/022
See application file for complete search history.

(56) References Cited

U.S. PATENT DOCUMENTS 2,997,887 A * 8/1961 Lott ..... F04B 47/02 74/41
3,029,650 A * 4/1962 Byrd ..... F04B 47/02 74/41
3,310,988 A 3/1967 Gault
3,406,581 A * 10/1968 Eyler ..... F04B 47/02 74/41
4,051,736 A 10/1977 Jones
4,505,162 A * 3/1985 Hoh ..... F04B 47/028 74/108
4,671,126 A 6/1987 Sable
4,703,665 A * 11/1987 Thompson ..... F04B 47/028 74/41
4,743,172 A 5/1988 Watson
5,105,671 A * 4/1992 Slater ..... F04B 47/022 417/411

(Continued)

FOREIGN PATENT DOCUMENTS

CN 1888375 A 1/2007

OTHER PUBLICATIONS

Weatherford, Surface Pumping Units, Catalog, 2014-2016.

(Continued)

*Primary Examiner* — William Kelleher
*Assistant Examiner* — Gregory T Prather
(74) *Attorney, Agent, or Firm* — Dentons Cohen & Grigsby P.C.

(57) ABSTRACT

A pump jack includes a number of standard components that have been sized and configured according to unique relative dimensions to produce a pump jack that reduces structural stress, increases bearing life and permits a lower cost of manufacture. These geometric ratios can be used to express the relative size and spacing of the crankshaft, crank arms, center bearing, equalizer bearing, walking beam and pitman arms. Pump jacks incorporating one or more of these geometric ratios can be sized and scaled for a variety of pumping applications.

8 Claims, 3 Drawing Sheets

(56) References Cited

U.S. PATENT DOCUMENTS

| | | | | |
|---|---|---|---|---|
| 5,253,541 | A * | 10/1993 | Mangle | F04B 47/022 74/41 |
| 6,015,271 | A * | 1/2000 | Boyer | F04B 47/022 417/321 |
| 7,406,887 | B2 | 8/2008 | Jensen | |
| 8,240,221 | B2 | 8/2012 | Simpson et al. | |
| 2010/0170353 | A1* | 7/2010 | Mattison | E21B 43/127 74/41 |
| 2012/0031208 | A1 | 2/2012 | Simpson et al. | |
| 2012/0205119 | A1 | 8/2012 | Wentworth et al. | |
| 2013/0030721 | A1* | 1/2013 | Palka | F04B 47/026 702/41 |
| 2016/0003236 | A1 | 1/2016 | Mills | |

OTHER PUBLICATIONS

Schlumberger, Shores Conventional Unit, Brochure, 2017.
S.G. Gibbs (Nabla Corp.), Assumptions of the API Rod Pumping Design Method as Related to Practical Applications and Wave Equation Techniques, 1994 (Abstract Only).
ISA/KRI; International Search Report for PCT/US2018/040736; Nov. 13, 2018.
ISA/KR; Written Opinion for PCT/US2018/040736; Nov. 13, 2018.
IB; Int'l Preliminary Report on Patentability; for PCt/US2018/040736; Feb. 4, 2020.
GCC Patent Office; Examination Report for Application No. GC 2018-35731; Feb. 29, 2020.

* cited by examiner

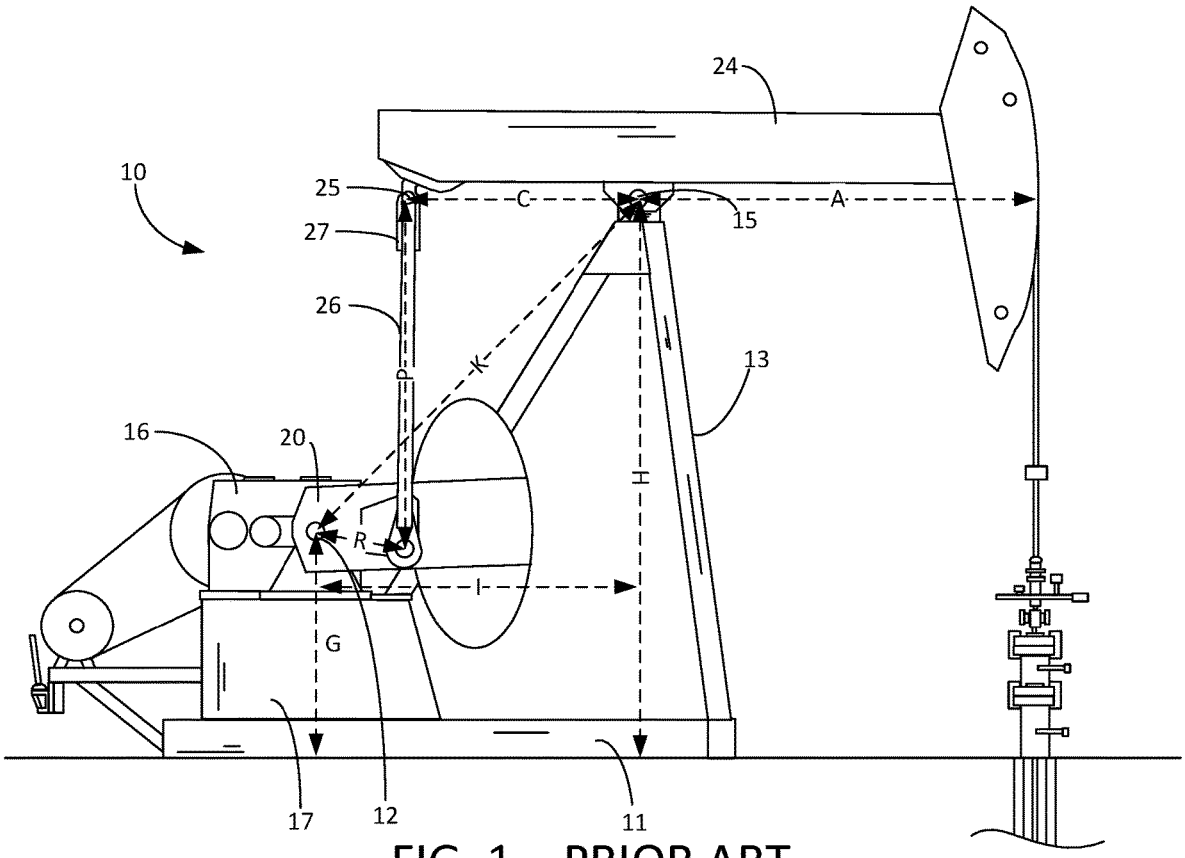
FIG. 1 – PRIOR ART
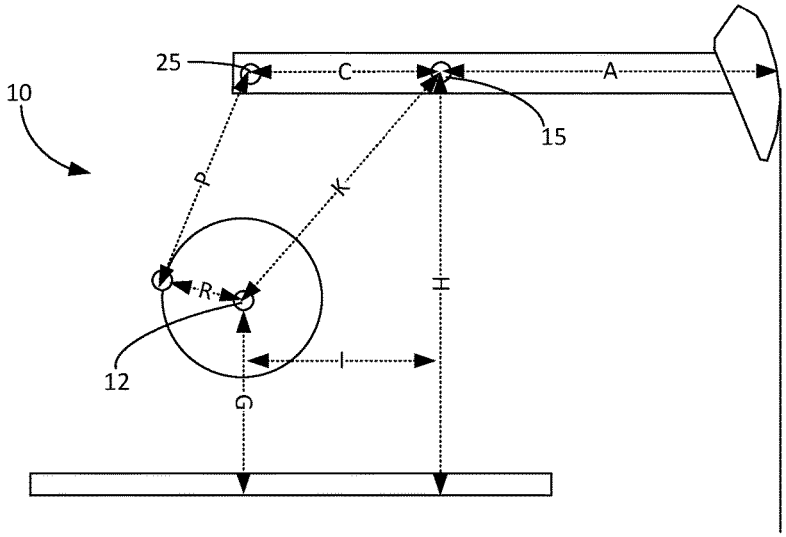
FIG. 2 - PRIOR ART

BEAM PUMPING UNIT WITH GEOMETRY OPTIMIZED FOR BEARING STRESS REDUCTION

FIELD OF THE INVENTION

This invention relates generally to oilfield equipment, and in particular to surface-mounted reciprocating-beam pumping units, and more particularly, but not by way of limitation, to beam pumping units with geometries that have been optimized to improve efficiency and reduce structural stresses.

BACKGROUND

Hydrocarbons are often produced from well bores by reciprocating downhole pumps that are driven from the surface by pumping units. A pumping unit is connected to its downhole pump by a rod string. Although several types of pumping units for reciprocating rod strings are known in the art, walking beam style pumps enjoy predominant use due to their simplicity and low maintenance requirements.

A walking beam pump jack operates, in essence, as a simple kinematic four-bar linkage mechanism, in which each of four rigid links is pivotally connected to two other of the four links to form a closed polygon. In a four-bar linkage mechanism, one link is typically fixed, with the result that a known position of only one other body is determinative of all other positions in the mechanism. The fixed link is also known as the ground link. The two links connected to the ground link are referred to as grounded links, and the remaining link not directly connected to the fixed ground link is referred to as the coupler link. Four-bar linkages are well known in mechanical engineering disciplines and are used to create a wide variety of motions with just a few simple parts.

Referring to FIG. 1, a four-bar linkage is embodied in the design of a prior art pump jack (10) as follows. A fixed link (Link K) extends from the centerline of the crankshaft (12) to the centerline of the center bearing (15). Link K is defined by a grounded frame formed of interconnected rigid bodies including the samson post (13), the base (11), the gearbox pedestal (17), and the reducer gearbox (16). The first grounded link (Link R) is defined by the crank arms (20), and the second grounded link (Link C) is defined by the rear portion of the walking beam (24) extending from the centerline of the center bearing (15) to the centerline of the equalizer bearing (25). The equalizer bearing (25), pitmans (26) and the equalizer (27) together define the coupler link (Link P). This four-bar linkage is dimensioned so as to convert rotational motion of Link R into pivotal oscillation of Link C via the coupler Link P and the fixed Link K. That is, the crank arms (20) seesaw the walking beam (24) about the center bearing (15) atop the samson post (13) via the pitman arms (26) and equalizer (27).

Substantially all of the operating characteristics of a pump jack are determined by the dimensions of its four-bar linkage. For example, the torque factor relationship, polish rod position, stroke length, and are dependent on the four-bar linkage dimensions. Torque factors and are important parameters used to define the load carrying capacity of the pump jack. The varying interaction of these two terms with polish rod position is used to define permissible polish rod load envelope curves that are compared with measured dynamometer load data to verify that the reducer gearbox is operating within the designed torque loading.

The determination of pump jack operating characteristics is greatly simplified by the American Petroleum Institute ("API") Specification 11E ("Specification for Pumping Units"). API Specification 11E includes derived operational parameters as a function of the geometry of a pumping unit's four-bar linkage, expressed in terms of standardized geometry designations. Accordingly, pump jacks are commonly specified in terms of the API geometry designations, and nearly all pump jack manufacturers provide these API geometry dimensions.

FIG. 2 presents a depiction of the prior art pump jack 10 in which the various API characteristics of the pump jack 10 are more prominently displayed to emphasize the relative geometries of the various components. For example, the ratio of length "A" (center bearing to polish rod) to length "R" (crank throw distance) is about 4.46-to-1. The remaining API dimensions can also be expressed as a ratio to the crank throw distance "R." Table 1 below presents several ratios of API dimensions with respect to a fixed crank throw "R":

TABLE 1

| Conventional Geometric Ratios | |
|---|---|
| Pitmans (P) to Crank Throw (R) | 3.16:1 |
| Center Bearing to Equalizer (C) to Crank Throw (R) | 2.57:1 |
| Horizontal Distance from Center Bearing to Crankshaft (I) to Crank Throw (R) | 2.55:1 |
| Center Bearing to Crankshaft (K) to Crank Throw (R) | 4.1:1 |

Although these conventional geometries have been employed in the past with suitable success, volatile commodity prices have increased the need for smaller, more efficient and cost effective pumping units. It is to these and other deficiencies in the prior art that the present invention is directed.

SUMMARY OF THE INVENTION

In one aspect, the present invention includes a pump jack configured to raise and lower a polish rod. The pump jack includes a crankshaft and crank arms connected to the crankshaft. The crank arms provide a maximum throw length "R". The pump jack also includes a samson post that supports a center bearing spaced from the crankshaft at a total distance "K" and at a horizontal distance "I". The pump jack further includes a walking beam pivotably supported by the center bearing on the samson post, an equalizer bearing assembly on a first end of the walking beam spaced at a distance "C" from the center bearing and a horsehead on the second end of the walking beam. The horsehead is connected to the polish rod at a horizontal distance "A" from the center bearing. The pump jack also includes pitman arms that have an effective length "P" that are connected between the crank arms and the equalizer bearing assembly. The ratio of the horizontal distance "A" between the center bearing and the polish rod to the maximum throw length "R" of the crank arms is between about 1.1 and 4.0. This is to allow for stroke lengths between 86" and 300".

In another aspect, the present invention includes a pump jack configured to raise and lower a polish rod. The pump jack includes a crankshaft and crank arms connected to the crankshaft. The crank arms provide a maximum throw length "R". The pump jack also includes a samson post that supports a center bearing spaced from the crankshaft at a total distance "K" and at a horizontal distance "I". The pump jack further includes a walking beam pivotably supported by the center bearing on the samson post, an equalizer bearing assembly on a first end of the walking beam spaced at a distance "C" from the center bearing and a horsehead on the second end of the walking beam. The horsehead is connected to the polish rod at a horizontal distance "A" from the center bearing. The pump jack also includes pitman arms that have an effective length "P" that are connected between the crank arms and the equalizer bearing assembly. The ratio of the distance "K" between the center bearing and the crankshaft to the maximum throw length "R" of the crank arms is between about 3.1 and 3.5.

In yet another aspect, the present invention includes a pump jack configured to raise and lower a polish rod. The pump jack includes a crankshaft and crank arms connected to the crankshaft. The crank arms provide a maximum throw length "R". The pump jack also includes a samson post that supports a center bearing spaced from the crankshaft at a total distance "K" and at a horizontal distance "I", where the ratio of the distance "K" between the center bearing and the crankshaft to the maximum throw length "R" of the crank arms is between about 3.1 and 3.5.

The pump jack further includes a walking beam pivotably supported by the center bearing on the samson post, an equalizer bearing assembly on a first end of the walking beam spaced at a distance "C" from the center bearing and a horsehead on the second end of the walking beam. The horsehead is connected to the polish rod at a horizontal distance "A" from the center bearing, where the ratio of the horizontal distance "A" between the center bearing and the polish rod to the maximum throw length "R" of the crank arms is between about 1.1 and 4.0. The pump jack also includes pitman arms that have an effective length "P" that are connected between the crank arms and the equalizer bearing assembly, where the ratio of the effective length "P" of the pitmans to the maximum throw length "R" of the crank arms is between about 2.5 and 2.8.

BRIEF DESCRIPTION OF THE DRAWINGS

FIG. 1 is a side view of a prior art pump jack.

FIG. 2 is a representation of the geometries of a prior art pump jack.

WRITTEN DESCRIPTION

Figure 3:
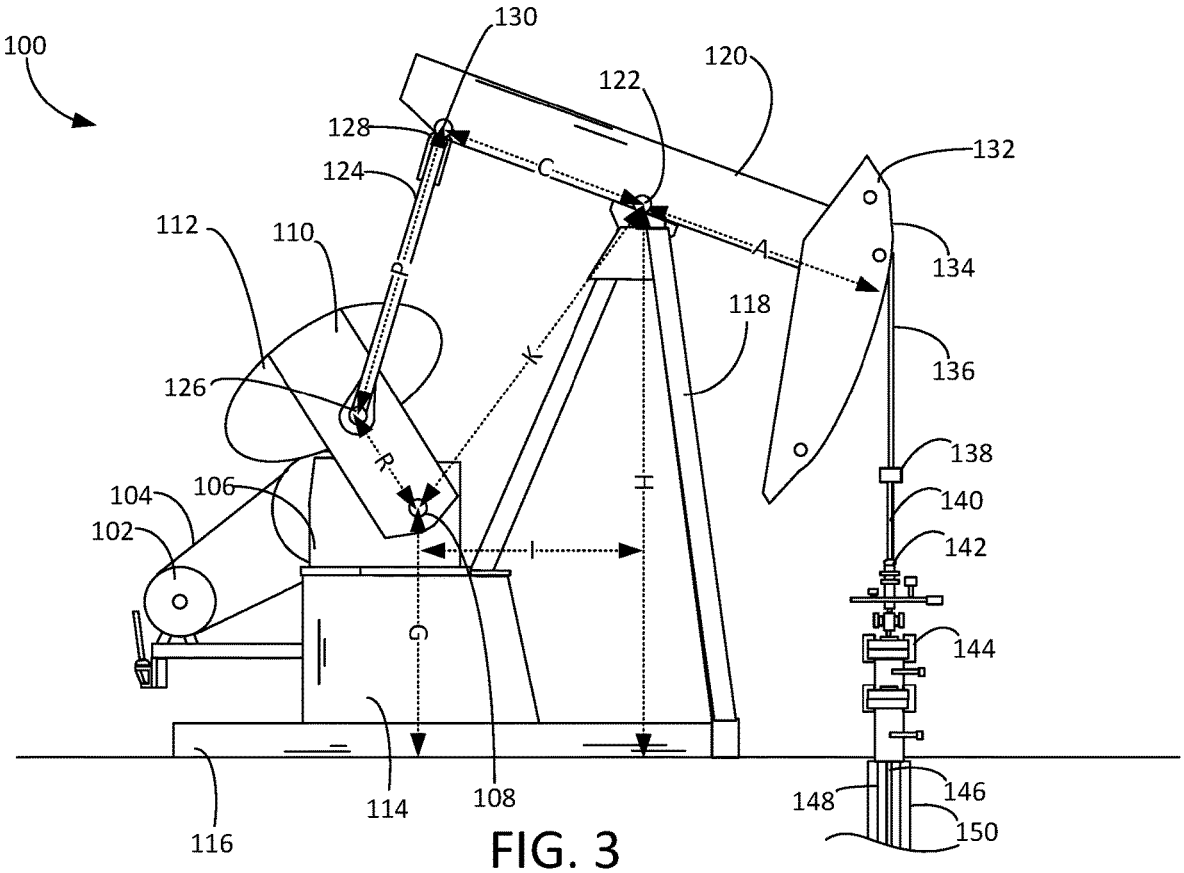
FIG. 3 is a side view of a pump jack constructed in accordance with an exemplary embodiment.

FIG. 3 shows a class 1 beam pump jack 100 constructed in accordance with a novel geometry that follows an exemplary embodiment of the present invention. The pump jack 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The reducer gearbox 106 sits atop a sub-frame or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a center bearing assembly 122, commonly referred to as a saddle bearing assembly.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130, commonly referred to as a tail bearing assembly. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polish rod 140 is suspended.

The polish rod 140 extends through a packing gland or stuffing box 142 on a wellhead 144. A rod string 146 of sucker rods hangs from the polish rod 140 within a tubing string 148 located within the well casing 150. The rod string is connected to the plunger of a subsurface pump (not illustrated). In a reciprocating cycle of the pump jack 100, well fluids are lifted within the tubing string 148 during the rod string 146 upstroke.

The lengths of the various components within the pump jack 100 were determined using extensive computer modeling and simulations that were configured to identify a pump jack 100 that exhibits improvements in selected design criteria, including enhanced bearing life, reduced structural stresses, and lower manufacturing costs. The computer-aided design process employed iterative calculations that were focused on identifying the relative geometries of the components within the pump jack 100 that optimize the selected design criteria. This unique design process yielded a range of optimal geometric ratios for the pump jack 100 that are not observed in the prior art.

Figure 4:
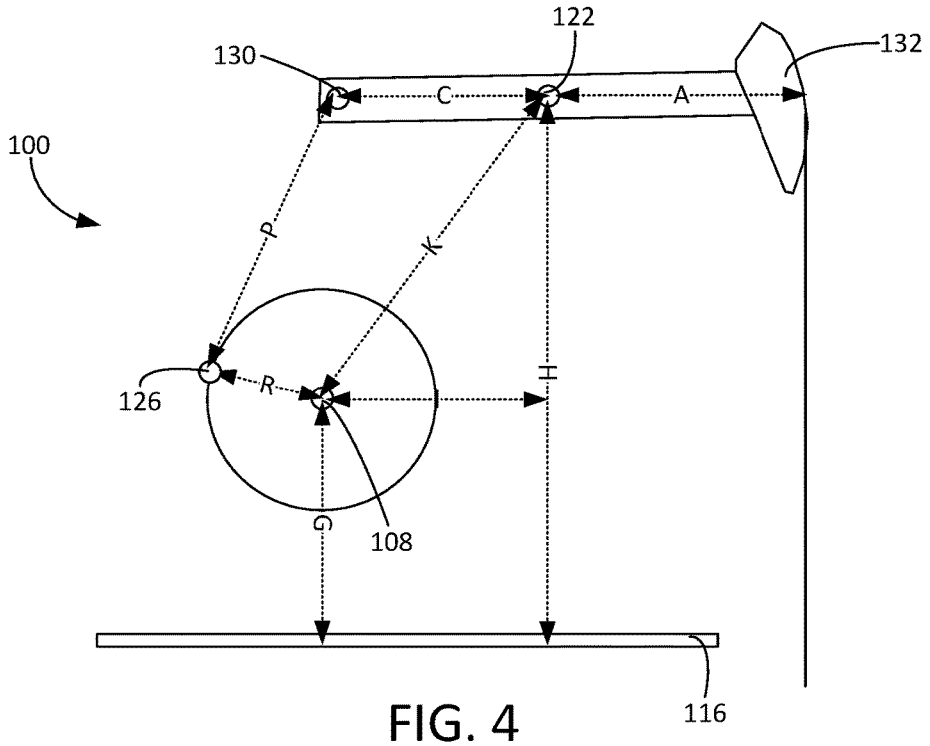
FIG. 4 is a representation of the geometries of the pump jack of FIG. 3.

Turning to FIG. 4, shown therein is a graphical representation that more clearly illustrates the novel geometry employed within the first embodiment of the pump jack 100 depicted in FIG. 3. Table 2 below presents several ratios of API dimensions with respect to a fixed crank throw "R:"

TABLE 2

| First Embodiment Geometric Ratios | | |
|---|---|---|
| Measurement | Description | Ratio to "R" |
| R | Maximum Crank Throw Distance | 1:1 |
| A | Horizontal Distance from Center Bearing to Polish Rod | 2.2 (A/R) |
| P | Effective Length of Pitman | 2.7 (P/R) |
| C | Distance from Center Bearing to Equalizer Bearing | 1.9 (C/R) |
| I | Horizontal Distance from Center Bearing to Crankshaft | 1.9 (I/R) |
| K | Distance between Center Bearing and Crankshaft | 3.3 (K/R) |

In particular, the combination of these ratios yielded a design that met the applicable demands of a conventional pump jack, but with a smaller walking beam 120. Computer modeling indicates that the combination of these geometries significantly improved life for the equalizer bearing assembly 130, center bearing assembly 122 and crank pin bearing assembly 126.

The ratios identified in Table 2 and in FIGS. 3 and 4 fall within a range of optimized geometric ratios that were identified through the design process. These ranges are expressed below in Table 3:

TABLE 3

| Geometric Ratio Ranges | | |
|---|---|---|
| Ratio | Lower Limit | Upper Limit |
| A/R | 1.1 | 4.0 |
| P/R | 2.5 | 2.8 |
| C/R | 1.7 | 2.0 |
| I/R | 1.8 | 2.2 |
| K/R | 3.1 | 3.5 |

It is helpful to express these ratios with reference to the maximum throw distance "R" because this value is relatively constant across a fleet of pump jacks 100.

Figure 5:
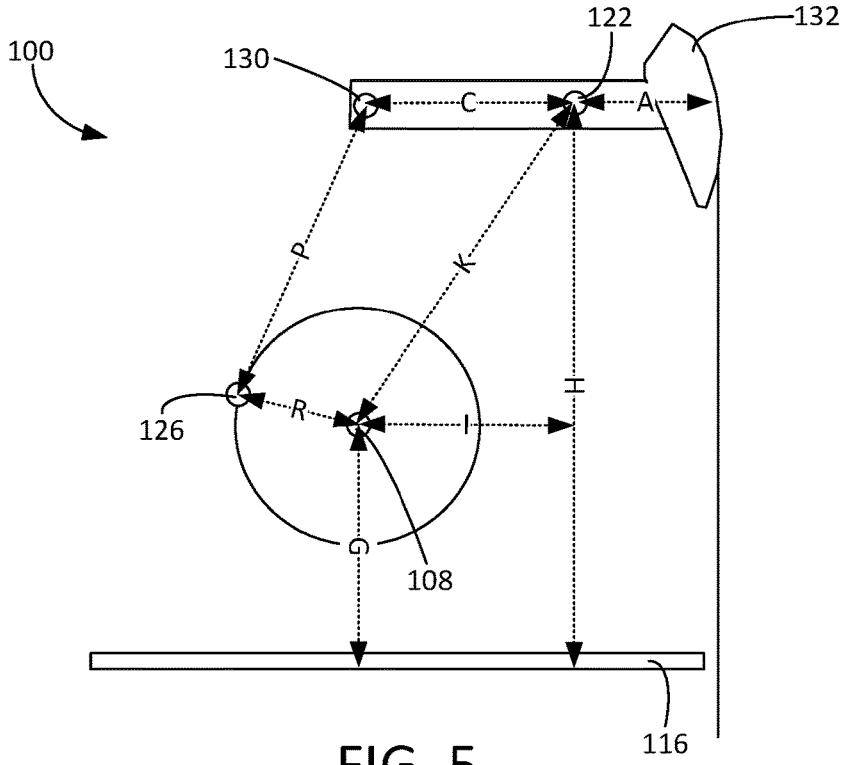
FIG. 5 is a representation of the geometries of a pump jack constructed in accordance with a second embodiment of the present invention.
Figure 6:
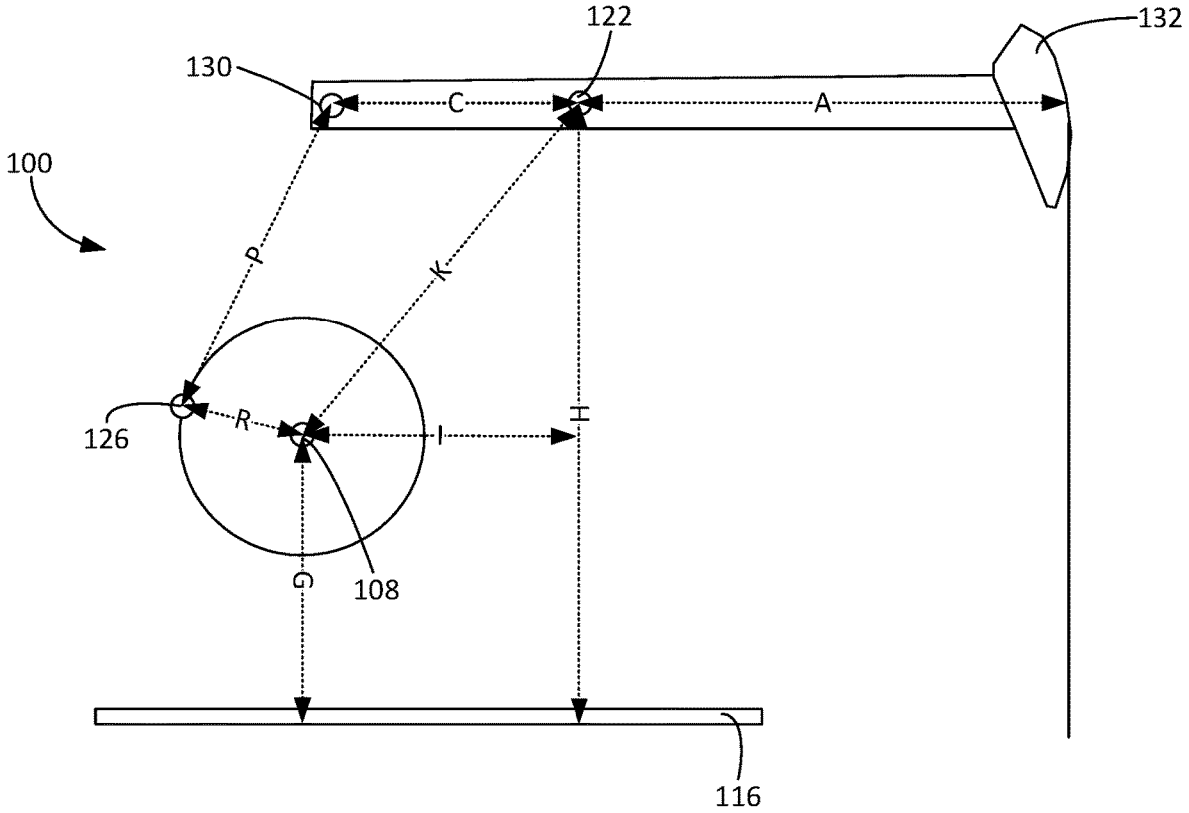
FIG. 6 is a representation of the geometries of a pump jack constructed in accordance with a third embodiment of the present invention.

It will be appreciated that there are a wide variety of pump jacks 100 that include geometries that fall within these ranges and are encompassed within exemplary embodiments of the present invention. For example, FIG. 5 provides a diagram of a pump jack 100 that includes components sized from the lower limit of the inventive geometric ratios in Table 3. The pump jack 100 of FIG. 5 presents a very compact unit that is well-suited for applications that require a small footprint. In contrast, FIG. 6 presents a depiction of a pump jack 100 that includes components sized from the upper limit of the inventive geometric ratios in Table 3. The pump jack 100 of FIG. 6 presents a significantly larger unit that includes geometries that are in some dimensions larger than conventional, prior art pump jacks.

The various pump jacks 100 depicted in FIGS. 3-6 are based on optimized geometries that reduce structural stresses and improve bearing life. Using these optimized geometric ratios, the pump jack 100 can therefore be designed and scaled for improved reliability and reduced maintenance. These geometries can also be used to produce a smaller pump jack 100 that reduces the cost of construction, transport and assembly while meeting application demands that are typically met with a much larger unit. It will be appreciated that pump jacks 100 can be constructed using one or more of the geometric ratios. In some embodiments, the pump jack 100 may include certain geometric ratios that fall outside the ranges outlined in Table 3.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A pump jack configured to raise and lower a polish rod, the pump jack comprising:

a crankshaft;

crank arms connected to the crankshaft, wherein the crank arms provide a maximum throw length "R";

a samson post, wherein the samson post supports a center bearing that is spaced from the crankshaft at a total distance "K" and at a horizontal distance "I", wherein the ratio of the distance "K" between the center bearing and the crankshaft to the maximum throw length "R" of the crank arms is about 3.3;

a walking beam pivotably supported by the center bearing on the samson post;

an equalizer bearing assembly on a rear end of the walking beam spaced at a distance "C" from the center bearing;

a horsehead on the front end of the walking beam, wherein the horsehead is connected to the polish rod at a horizontal distance "A" from the center bearing;

pitman arms connected between the crank arms and the equalizer bearing assembly, wherein the pitman arms have an effective length "P"; and wherein the ratio of the horizontal distance "A" between the center bearing and the polish rod to the maximum throw length "R" of the crank arms is between about 1.1 and 4.0.

2. The pump jack of claim 1, wherein the ratio of the horizontal distance "A" between the center bearing and the polish rod to the maximum throw length "R" of the crank arms is about 2.2.

3. The pump jack of claim 1, wherein the ratio of the horizontal distance "I" between the center bearing and the crankshaft to the maximum throw length "R" of the crank arms is between about 1.8 and 2.2.

4. The pump jack of claim 3, wherein the ratio of the horizontal distance "I" between the center bearing and the crankshaft to the maximum throw length "R" of the crank arms is about 1.9.

5. A pump jack configured to raise and lower a polish rod, the pump jack comprising:

a crankshaft;

crank arms connected to the crankshaft, wherein the crank arms provide a maximum throw length "R";

a samson post, wherein the samson post supports a center bearing that is spaced from the crankshaft at a total distance "K" and at a horizontal distance "I";

a walking beam pivotably supported by the center bearing on the samson post;

an equalizer bearing assembly on a rear end of the walking beam spaced at a distance "C" from the center bearing;

a horsehead on the front end of the walking beam, wherein the horsehead is connected to the polish rod at a horizontal distance "A" from the center bearing;

pitman arms connected between the crank arms and the equalizer bearing assembly, wherein the pitman arms have an effective length "P", wherein the ratio of the effective length "P" of the pitmans to the maximum throw length "R" of the crank arms is between about 2.5 and 2.8; and wherein the ratio of the horizontal distance "A" between the center bearing and the polish rod to the maximum throw length "R" of the crank arms is between about 1.1 and 4.0.

6. The pump jack of claim 5, wherein the ratio of the effective length "P" of the pitmans to the maximum throw length "R" of the crank arms is about 2.7.

7. A pump jack configured to raise and lower a polish rod, the pump jack comprising:

a crankshaft;

crank arms connected to the crankshaft, wherein the crank arms provide a maximum throw length "R";

a samson post, wherein the samson post supports a center bearing that is spaced from the crankshaft at a total distance "K" and at a horizontal distance "I";

a walking beam pivotably supported by the center bearing on the samson post;

an equalizer bearing assembly on a rear end of the walking beam spaced at a distance "C" from the center bearing, wherein the ratio of the distance "C" between the equalizer bearing assembly and the center bearing to the to the maximum throw length "R" of the crank arms is between about 1.7 and 2.0;

a horsehead on the front end of the walking beam, wherein the horsehead is connected to the polish rod at a horizontal distance "A" from the center bearing;

pitman arms connected between the crank arms and the equalizer bearing assembly, wherein the pitman arms have an effective length "P"; and wherein the ratio of the horizontal distance "A" between the center bearing and the polish rod to the maximum throw length "R" of the crank arms is between about 1.1 and 4.0.

8. The pump jack of claim 7, wherein the ratio of the distance "C" between the equalizer bearing assembly and the center bearing to the to the maximum throw length "R" of the crank arms is about 1.9.

* * * * *